US006648372B2

(12) United States Patent
Ojeda, III

(10) Patent No.: US 6,648,372 B2
(45) Date of Patent: Nov. 18, 2003

(54) SKATEBOARD TRUCK GUARD

(76) Inventor: Felix Ojeda, III, 2220 Carnegie La., Unit C, Redondo Beach, CA (US) 90278

( * ) Notice: Subject to any disclaimer, the term of this patent is extended or adjusted under 35 U.S.C. 154(b) by 0 days.

(21) Appl. No.: 10/081,679

(22) Filed: Feb. 25, 2002

(65) Prior Publication Data

US 2003/0160441 A1 Aug. 28, 2003

(51) Int. Cl.[7] ..... A63C 3/00
(52) U.S. Cl. ..... 280/809; 280/11.27; 150/154
(58) Field of Search ..... 280/809, 811, 280/11.27, 87.042, 87.041, 87.01, 825; 150/166, 154

(56) References Cited

U.S. PATENT DOCUMENTS 4,214,768 A * 7/1980 Dominy et al. ..... 280/809
5,560,625 A * 10/1996 Kuykendall ..... 280/809
5,664,808 A * 9/1997 Whidden et al. ..... 280/809
5,806,860 A * 9/1998 Conte ..... 280/809
5,879,013 A * 3/1999 Shih ..... 280/809
6,056,302 A * 5/2000 Smith ..... 280/809
6,105,978 A * 8/2000 Vuerchoz ..... 280/11.27
6,416,081 B1 * 7/2002 Goodman ..... 280/809

* cited by examiner

*Primary Examiner*—Brian L. Johnson
*Assistant Examiner*—Jeffrey Restifo
(74) *Attorney, Agent, or Firm*—Raymond Y. Chan; David and Raymond Patent Group

(57) ABSTRACT

A skateboard truck guard, which is adapted for attaching to a truck having a bottom portion and defining a ground contacting surface thereon, includes an elongated guard body, which is shaped and sized for detachably mounting to the bottom portion of the truck, having an outer side and defining a grinding surface thereon, and an inner side for covering the ground contacting surface and a fastening arrangement mounted on the guard body for securely fastening the guard body on the truck.

19 Claims, 8 Drawing Sheets

SKATEBOARD TRUCK GUARD

BACKGROUND OF THE PRESENT INVENTION

1. Field of Invention

The present invention relates to a skateboard, and more particularly to a skateboard truck guard which is adapted for detachably attaching to a truck of a skateboard, so as to minimize the deterioration or damage to the truck while performing the grinding skateboard trick and extend the service life span of the truck while being cost effective.

2. Description of Related Arts

Nowadays, skateboards are well known and have been considered as a form of transportation, recreation, and exercise. A conventional skateboard comprises a step board and two wheel assemblies spacedly attached underneath the step board, wherein each of the wheel assemblies comprises two wheels and a truck which connects the wheels to the step board and allows the step board to turn.

The truck generally comprises a base plate attached underneath the step board, a truck body extended downwardly from the base plate, and two axles opposedly and sidewardly extended from the truck body for rotatably mounting the wheels respectively.

When playing the skateboard, a downward force of a skateboard player's weight is mainly supported by the truck in such a manner that a stress is created round the truck body. As a result, the truck body will be distorted or cracked at the stress point, which may cause an unwanted injury for the player. Therefore, the truck must be made of durable material, such as metal, in order to prevent the distortion of the truck over a period of continued use.

Moreover, most of the skateboard players like to do some tricks such as "crooked grind", "50-50 grind","nosegrind", or "5-0 grind". Those grind tricks require the truck scratching on a sliding surface such as a curb or railing. When the truck grinds along the sliding surface, a frictional force is created therebetween. The frictional force will create not only heat but also a shear force on the truck such that the truck will be worn out easily. Even some players may merely apply a wax layer on the truck in order to reduce the friction while grinding, the wax layer is easily scraped off and must be repeatedly applied on the truck. Therefore, once the truck body is worn out, the truck cannot be repaired. On other words, the truck body must be replaced, which is costly.

SUMMARY OF THE PRESENT INVENTION

A main object of the present invention is to provide a skateboard truck guard which is adapted for detachably mounting to a truck of a skateboard, so as to minimize the deterioration or damage to truck, especially while performing the grinding skateboard trick.

Another object of the present invention is to provide a skateboard truck guard which comprises a guarding body for covering a grinding surface of the truck for preventing the truck from being scratched so as to extend the service life span of the truck while being cost effective.

Another object of the present invention is to provide a skateboard truck guard which comprises a fastener device to securely mount the guarding body on the truck so as to prevent the skateboard truck guard being detached from the truck accidentally.

Another object of the present invention is to provide a skateboard truck guard which is adapted to mount to all kinds of truck without altering the original structure of the truck. Moreover, the skateboard truck guard of the present invention is capable of mounting on the truck even though the truck is already worn out. Therefore, the skateboard truck guard can minimize the replacing cost of the truck and provide a better grinding performance for the skateboard.

Another object of the present invention is to provide a skateboard truck guard which can be made of various materials for providing different grinding effects of skateboard tricks. In other words, the skateboard truck guard can provide a smooth grinding surface for reducing a friction that allows the skateboard to grind on the sliding surface smoothly. Otherwise, the skateboard truck guard can provide a rough grinding surface for increasing the friction that allows the player to perform a trick, such as producing sparks, without deteriorating the truck.

Another object of the present invention is to provide a skateboard truck guard, wherein no expensive or complicated structure is required to employ in the present invention in order to achieve the above mentioned objects. Therefore, the present invention successfully provides an economic and efficient solution for providing a reinforced protecting configuration to the truck of the skateboard.

Accordingly, in order to accomplish the above objects, the present invention provides a skateboard truck guard for attaching to a truck having a bottom portion and is defining a ground contacting surface thereon, comprising:

an elongated guard body, which is shaped and sized for detachably mounting to the bottom portion of the truck, having an outer side and defining a grinding surface thereon, and an inner side for covering the ground contacting surface; and a fastening arrangement mounted on the guard body for securely fastening the guard body on the truck.

DETAILED DESCRIPTION OF THE PREFERRED EMBODIMENT

Figure 1:
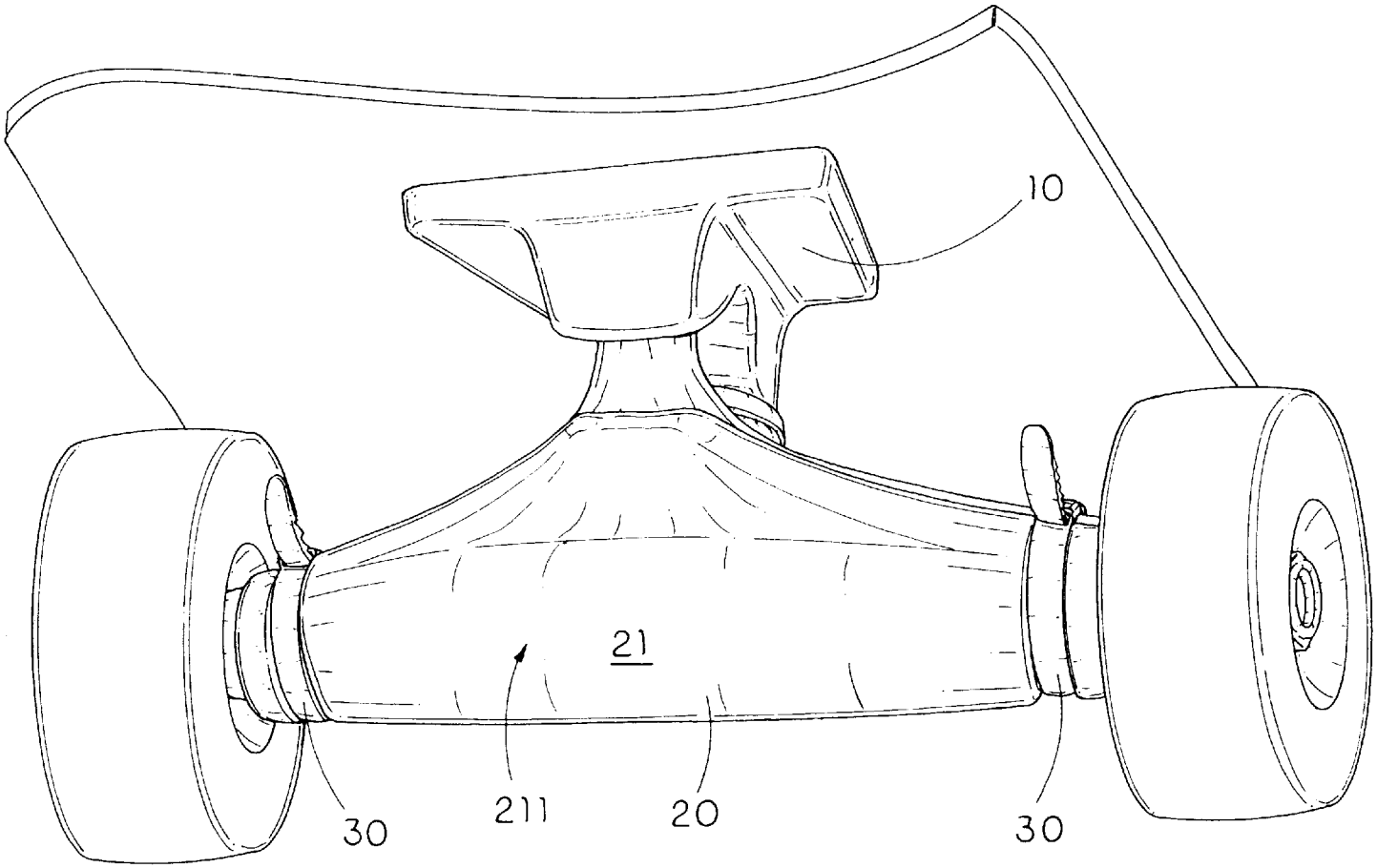
FIG. 1 is a perspective view of a skateboard truck guard mounted to a truck of a skateboard according to a first preferred embodiment of the present invention.
Figure 2:
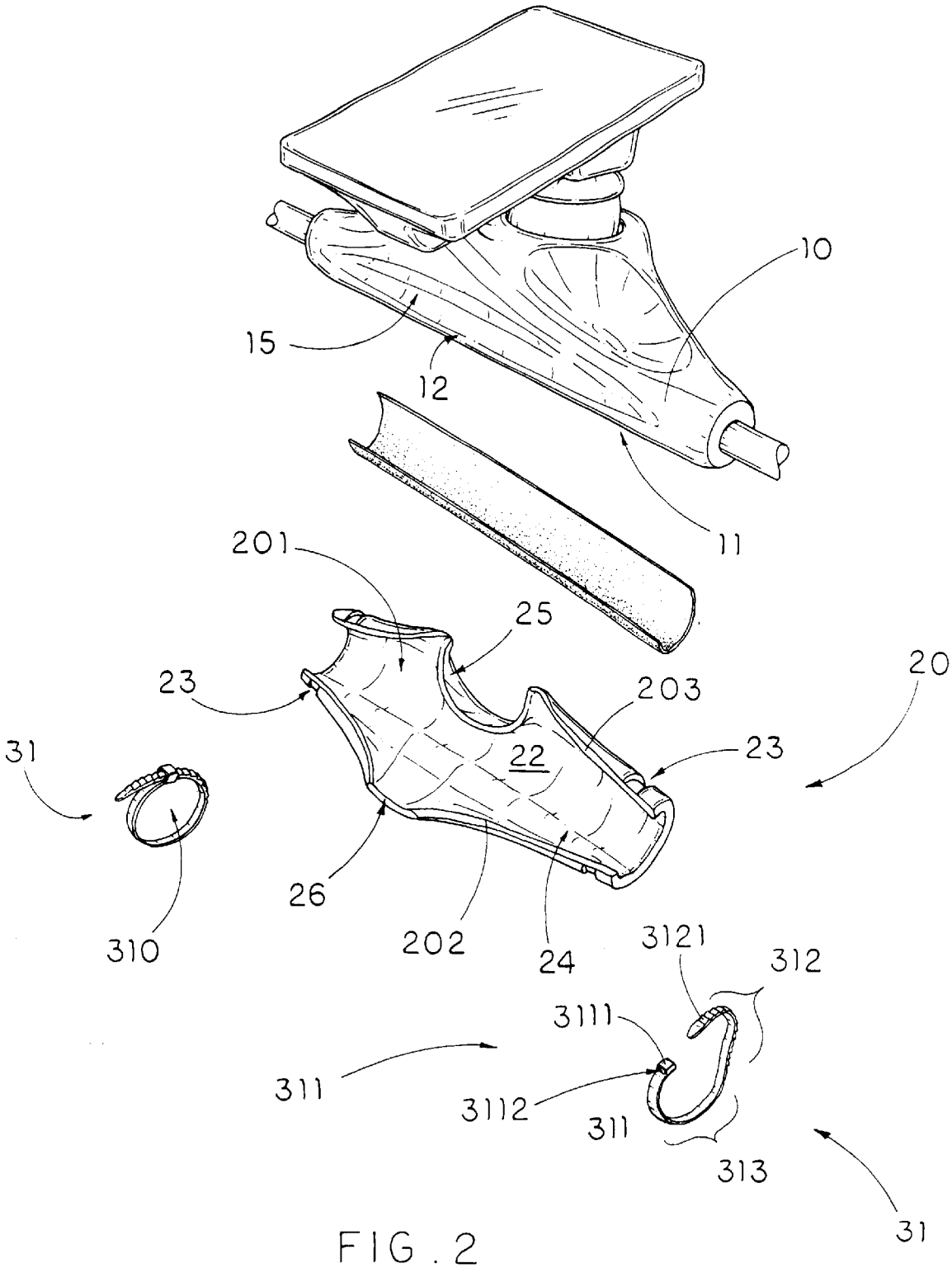
FIG. 2 is an exploded perspective view of the skateboard truck guard according to the above first preferred embodiment of the present invention.

Referring to FIGS. 1 and 2 of the drawings, a skateboard truck guard incorporated with a skateboard having a truck 10 according to a first preferred embodiment of the present invention is illustrated, wherein the skateboard truck guard adapted for fittedly attaching to the truck 10 having a bottom portion 11 and defining a ground contacting surface 12 thereon.

The skateboard truck guard comprises an elongated guard body 20, shaped and sized for detachably mounting to the bottom portion 11 of the truck 10, having an outer side 21 and defining a grinding surface 211 thereon and an inner side 22 for covering the ground contacting surface 12 of the truck 10.

The skateboard truck guard further comprises a fastening arrangement 30 mounted on the guard body 20 for securely fastening the guard body 20 on the truck 10.

According to the preferred embodiment, the guard body 20 generally has an arc-shaped cross section to form a longitudinal receiving cavity 201 having a sized and shaped adapted for fittedly receiving the bottom portion 11 of the truck 10 and first and second longitudinal edges 202, 203 defined at opening edges of the receiving cavity 201 respectively. The inner side 22 of the guard body 20 is defined at an inner peripheral surface of the receiving cavity 201 in such a manner that when the guard body 20 is mounted on the bottom portion 11 of the truck 10, the inner side 22 is covered up the ground contacting surface 12 of the truck 10, so as to protect the ground contacting surface 12 of the truck 10 being grinded along a sliding surface such as railing or curb.

The guard body 20 further has a longitudinal protruding portion 24 projected from the inner side 22 of the guard body 20 towards the receiving cavity 201 for fittedly engaging with an engagement groove 15 longitudinal formed on the bottom portion 11 of the truck 10 so as to align and hold the guard body 20 in position with respect to the truck 10. In other words, the guard body 20 is arranged to push towards the truck 10 into the receiving cavity 201 until the protruding portion 24 of the guard body 20 reaches the engagement groove 15 of the truck 10 so as to clip the guard body 20 on the truck 10, as shown in FIG. 2.

Accordingly, the grinding surface 211 is provided on the outer side 21 of the guard body 20 at a position that projecting from the ground contacting surface 12 of the truck 10 when the guard body 20 is mounted thereto. In other words, when the guard body 20 is mounted to the truck 10, the grinding surface 211 of the guard body 20 functions as the ground contacting surface 12 of the truck 10 so as to allow a player to perform the grinding tricks by using the grinding surface 211 of the guard body 20.

The guard body 20 is preferably made of a durable material such as alloy, polyurethane, or fiberglass for providing a predetermined friction of the grinding surface 211. When the guard body 20 is made of a material having a friction coefficient smaller than that of the truck 10 to provide a smooth grinding surface 211, the player is able to grind on the sliding surface farther in comparison with the ground contacting surface 12 of the truck 10. When the guard body 20 is made of a material having a friction coefficient larger than that of the truck 10 to provide a rough grinding surface 211, the player is able to perform some grinding tricks that cannot be preformed by the truck 10, such as producing sparks by grinding the grinding surface 211 against the sliding surface.

As shown in FIG. 2, the fastening arrangement 30 comprises two elongated fastening elements 31 mounted at two end portions of the guard body 20 respectively wherein each of the fastening elements 31 is arranged to form a fastening loop 310 for tightly encircling two end portions of the guard body 20 with two side portions of the truck 20, so as to securely attach the guard body 20 to the truck 10.

Each of the fastening elements 31 has a first and second fastening portions 311, 321 and a retaining portion 313 provided therebetween, wherein the retaining portion 313 is held on the guard body 20 in position and the first and second fastening portions 311, 312 are arranged to fasten with each other to form the fastening loop 310 for tightly encircling with two side portions of the truck 10.

As shown in FIG. 2, the two fastening elements 31, according to the preferred embodiment, are a pair of zip-ties, wherein the first fastening portion 311 of each of the fastening elements 31 has a locker member 3111 having a slider through slot 3112 and the second fastening portion 312 of each of the fastening elements 31 has a plurality of engaging teeth 3121 spacedly provided thereon in such a manner that when the second fastening portion 312 is slidably passing through the slider through slot 3112 of the locker member 3111 to form the fastening loop 310, the engaging teeth 3121 are securely interlocked with the locker member 3111 for locking up a reserved sliding movement of the second fastening portion 312 so as to securely fasten the first and second fastening portions 311, 312 with each other.

It is worth to mention that by adjusting a position of the locker member 3111 along the second fastening portion 312 of each of the fastening elements 31, a length of the fastening loop 310 is adapted to be adjusted to tightly encircle the respective side portion of the truck 10, as shown in FIG. 1. Thus, the fastening arrangement 30 is arranged to securely fasten the guard body 20 with the truck 10 at two side portions thereof such that even though the truck 10 is already worn out or slightly distorted, the fastening arrangement 30 is adapted to secure the attachment between the guard body 20 and any truck 10 in the market.

Figure 3A:
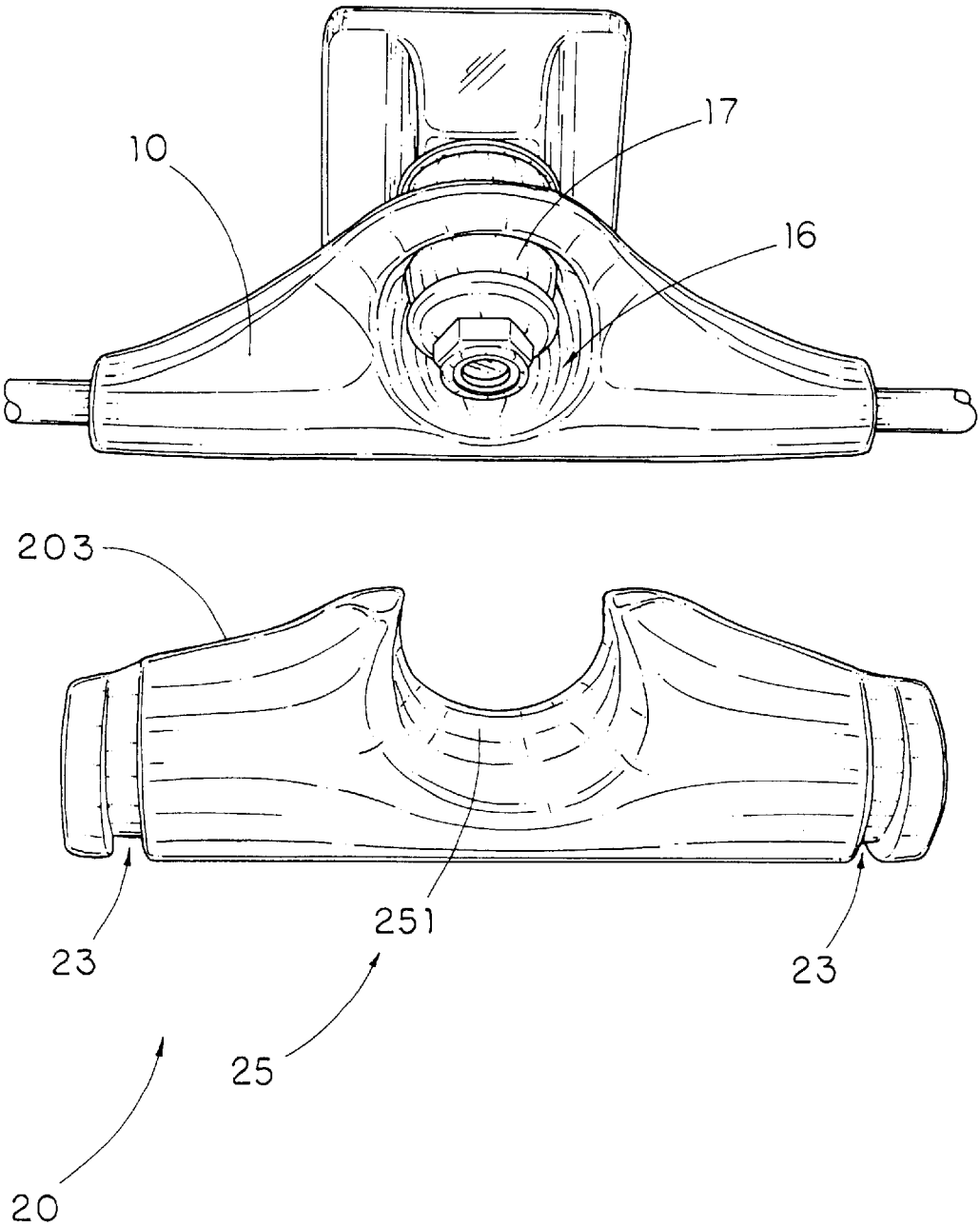
FIG. 3A is a perspective view of a holding member of the skateboard truck according to the above first preferred embodiment of the present invention.
Figure 3B:
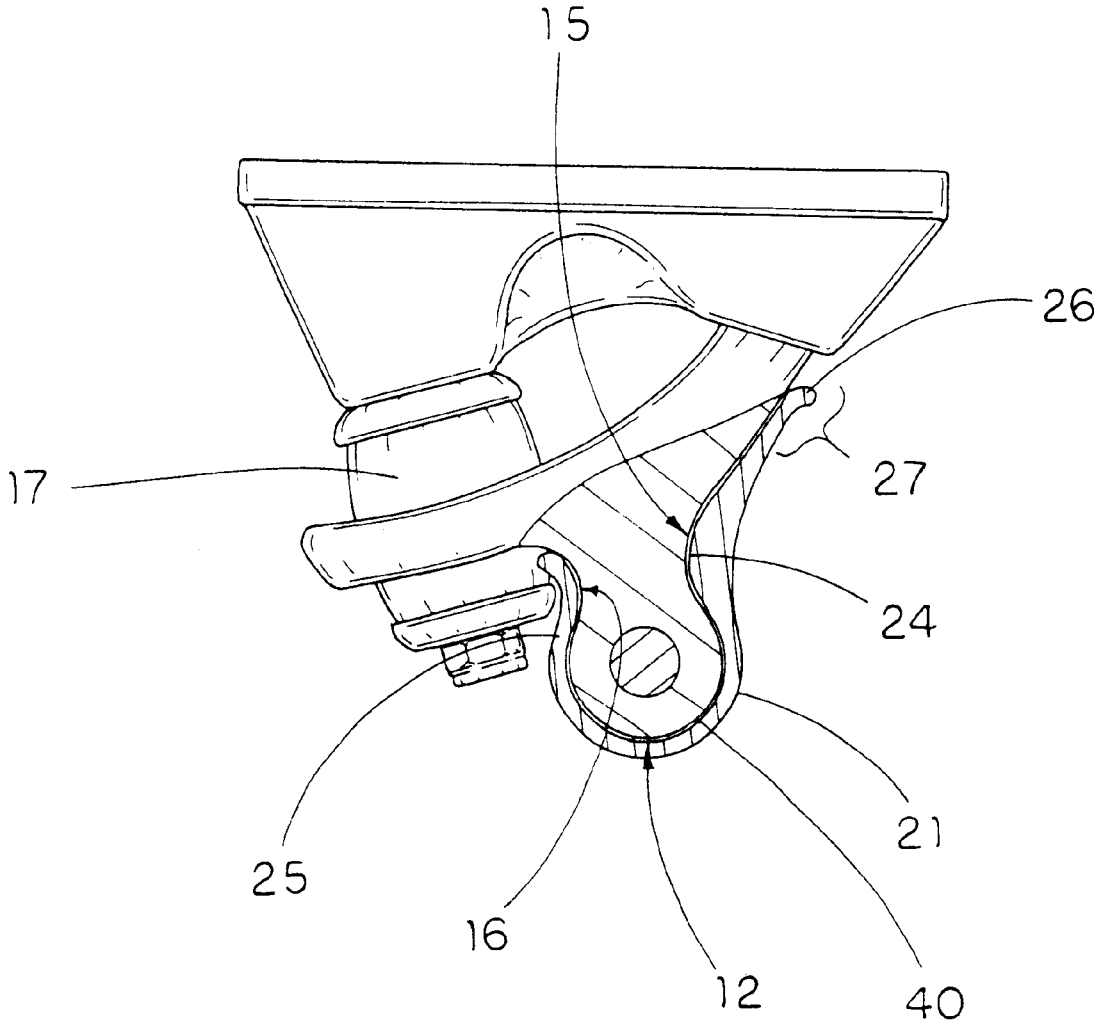
FIG. 3B is a sectional view of the skateboard truck mounted to the truck of the skateboard according to the above first preferred embodiment of the present invention.

The guard body 20 further has two guiding grooves 23 transversely provided on two end portions of the guard body 20 for holding the retaining portions 313 of the fastening elements 31 in position respectively, as shown in FIG. 3B.

Each of the guiding grooves 23 is transversely formed on the outer side 21 of the guard body 20 and is extended from the first longitudinal edge 202 of the guard body 20 to the second longitudinal edge 203 thereof. In other words, the two guiding grooves 23 are transversely indented on the two end portions of the outer side 21 of the guard body 20. Moreover, each of the guiding grooves 23 has a width at least wider than a width of each of the fastening elements 31 such that the retaining portion 313 of each fastening element 30 is fitted into the guiding groove 23. Therefore, the guiding grooves 23 not only guide the fastening elements 31 to align at two end portions of the guard body 20 respectively but also prevent any unwanted lateral sliding movement of the fastening elements 31 on the guard body 20.

Furthermore, when the player wants to detach the guard body 20 from the truck 10, the player is able to simply cut the fastening elements 31. Since the fastening elements 31 are relatively inexpensive and easy to find, the player is able to securely mount the guard body 20 to the truck 10 by using another new pair of fastening elements 31 rather than replacing another new truck when the old truck is worn out. For example, when the player borrows his or her friend skateboard, the player is able to mount the skateboard truck guard of the present invention on the skateboard in order to prevent the truck from being scratched. Once the player wants to play with his or her own skateboard, the player can mount the skateboard truck guard back thereto with another new pair of fastening elements 31.

As shown in FIGS. 3A and 3B, the guard body 20 further comprises a holding member 25 for holding the guard body 20 on the truck 10 in position wherein the holding member 25 comprises an arc-shaped holding rib 251 integrally extended from the second longitudinal edge 203 of the guard body 20 for fittedly engaging with a corresponding arc-shaped joint portion 16 of the truck 10 that a bushing assembly 17 is attached thereto. Due to the attachment between the truck 10 and the bushing assembly 17, a curved circumferential surface is defined at the joint portion 16 of the truck 10 wherein the holding rib 251 is shaped and sized to fittedly mounted on the curved circumferential surface of the joint portion 16 of the truck 10 for securely holding the guard body 20 on the truck 10 so as to prevent an unwanted lateral movement of the guard body 20 with respect to the truck 10.

In order to easily detach the guard body 20 from the truck 10, the guard body 20 further comprises a detaching pusher button 26 integrally extended from the first longitudinal edge 202 of the guard body 20 in an outwardly protruding manner, as shown in FIGS. 1 and 3B, in such a manner that the guard body 20 is capable of detaching from the truck 10 when the player applies a pushing force on the detaching pusher button 26.

The skateboard truck guard further comprises a foaming layer 40 provided on the inner side 22 of the guard body 20 wherein the foaming layer 40 is made of foam material, such as EVA, having a shape deforming ability in such a manner that the foaming layer 40 is capable of filling a gap formed between the inner side 22 of the guard body 20 and the ground contacting surface 12 of the truck 10, so that the guard body 20 is capable of fittedly mounting on the bottom surface 11 of the truck 10 so as to protect the ground contacting surface 12 thereof, Furthermore, the foaming layer 40 is capable of absorbing a portion of collision force when the guard body 20 grinding on the sliding surface so as to prevent the collision force directly transferring to the truck 10.

Figure 4:
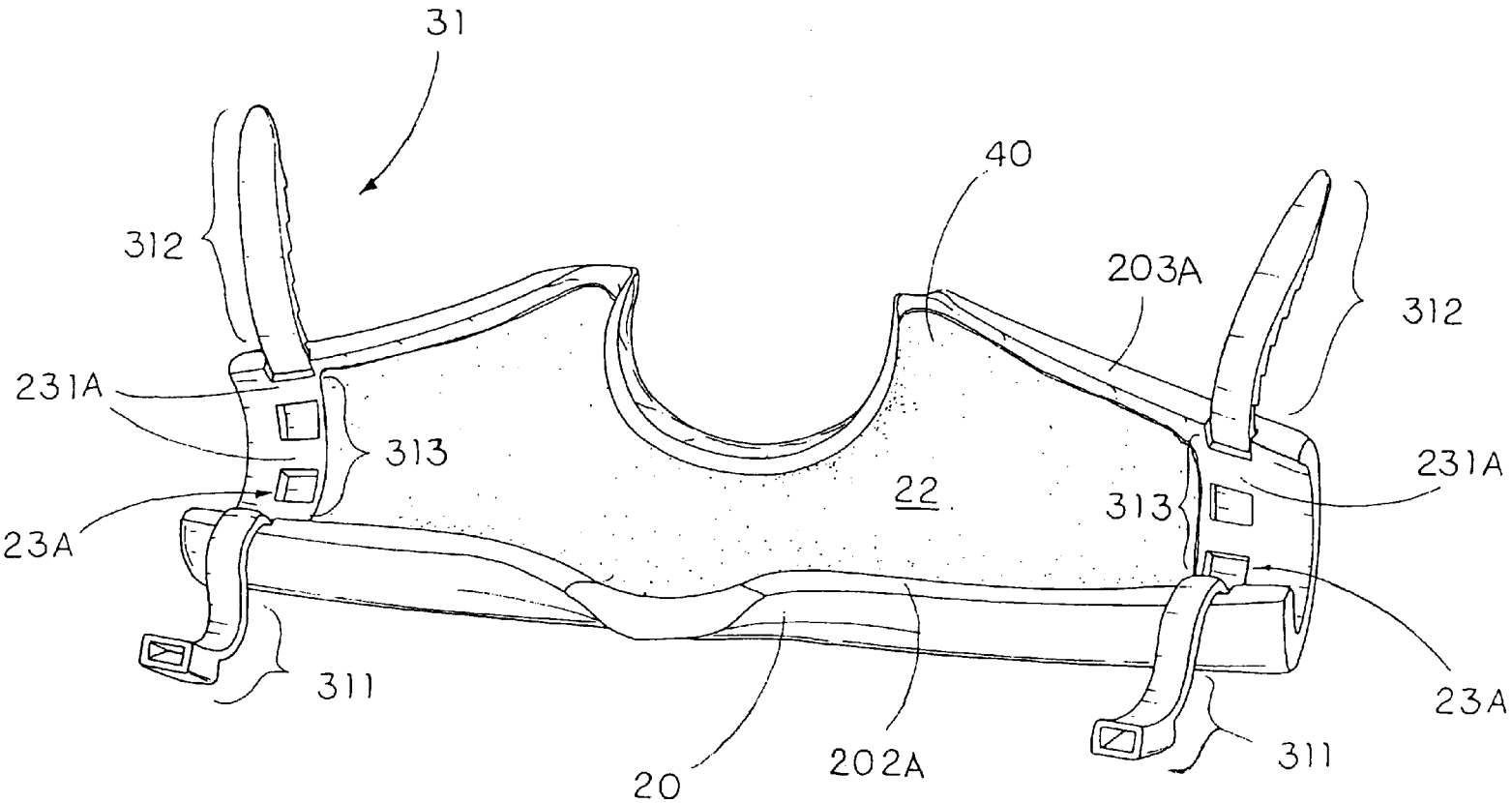
FIG. 4 illustrates an alternative mode of a guard body of the skateboard truck guard according to the above first preferred embodiment of the present invention.

FIG. 4 illustrates an alternative mode of the guiding grooves 23A provided at two end portions of the guard body 20 wherein each of the guiding grooves 23A is transversely indented on the inner side 22 of the guard body 20 and is extended from the first longitudinal edge 202A of the guard body 20 to the second longitudinal edge 203A thereof.

The guard body 20 further comprises at least two holding ridges 231A formed on the inner side 22 of the guard body 20 for enclosing the guiding grooves 23A respectively in such a manner that each of the fastening elements 31 is adapted to slidably pass through the respective guiding groove 23A while the retaining portion 313 of the fastening element 31 is held in the guiding groove 23A. Therefore, the retaining portions 313 of the fastening elements 31 are hidden inside of the guard body 20 so as to enhance the appearance of the guard body 20.

Figure 5:
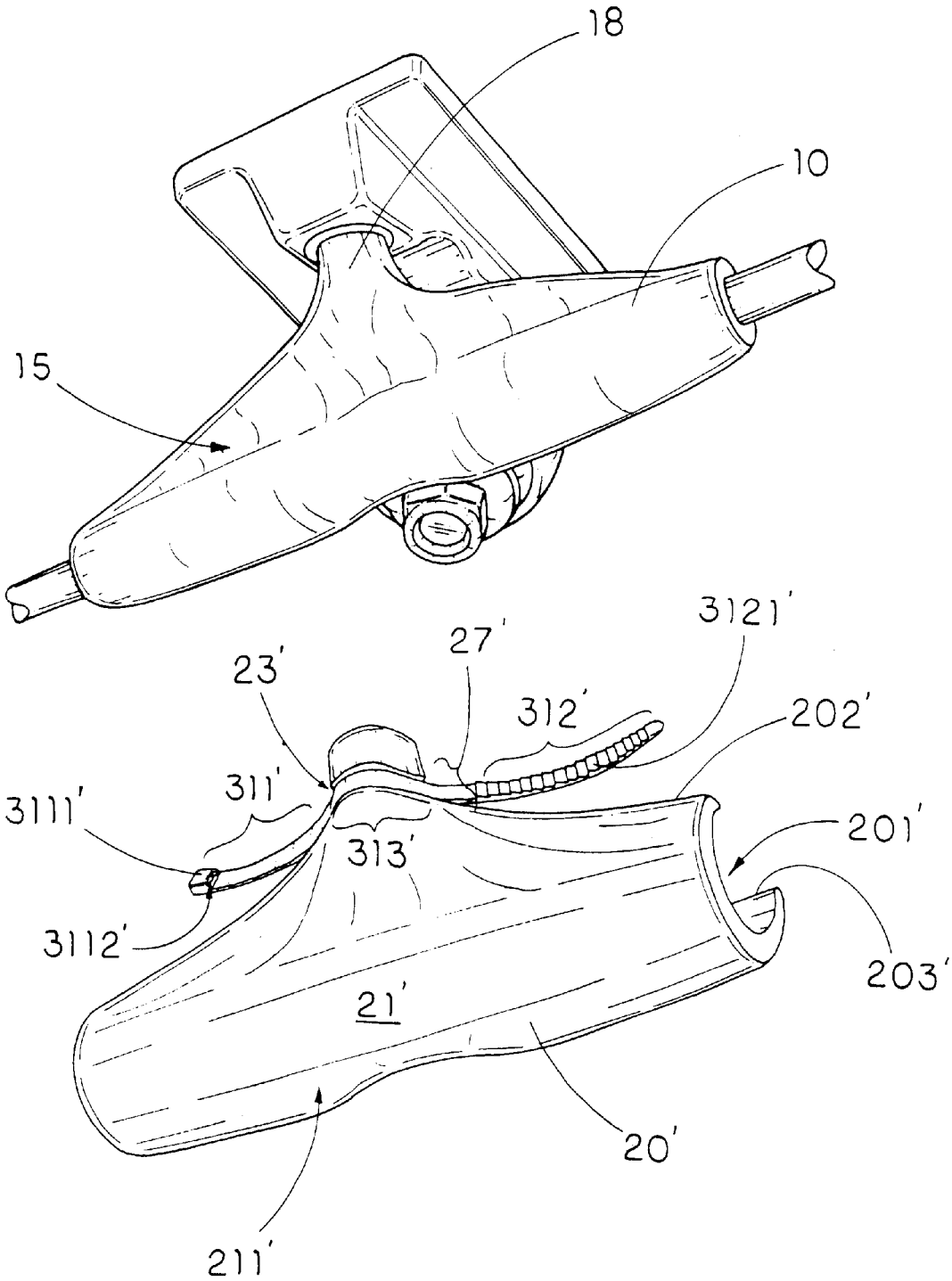
FIG. 5 is a perspective view of a skateboard truck guard according to a second preferred embodiment of the present invention.
Figure 6:
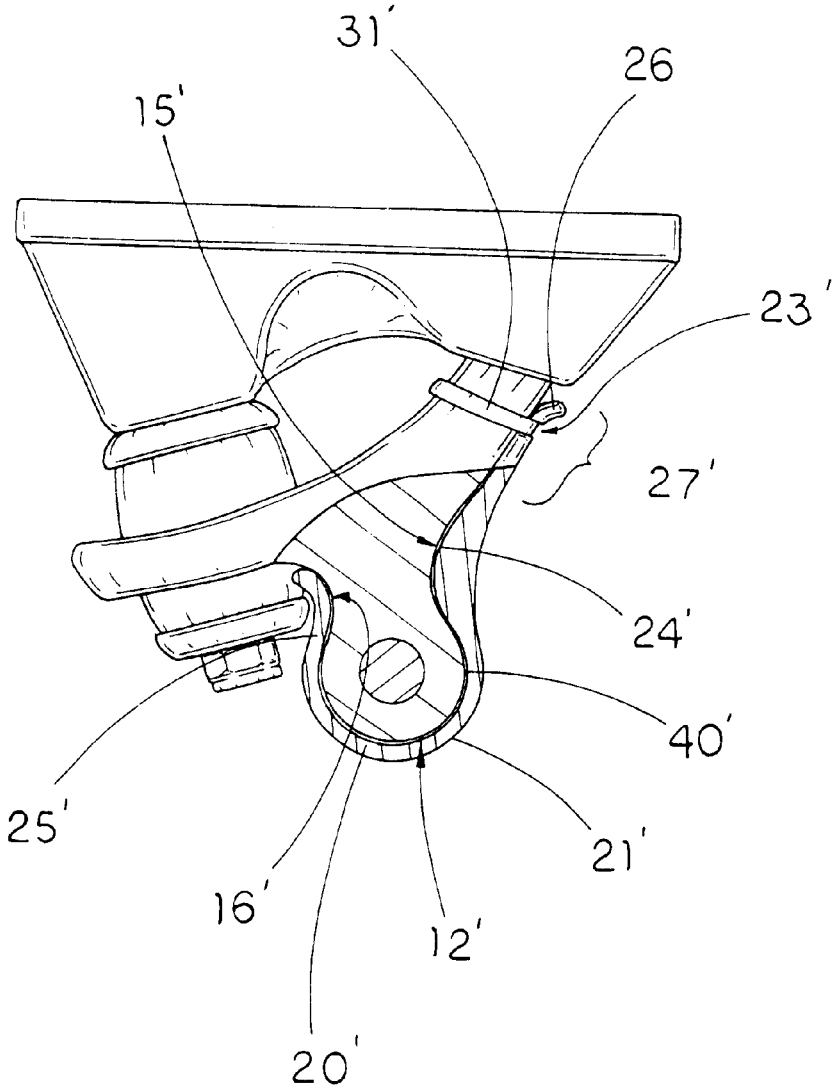
FIG. 6 is a sectional view of the skateboard truck guard according to the above second preferred embodiment of the present invention.

Referring to FIGS. 5 and 6, a second embodiment of the guard body 20' illustrates an alternative mode of the skateboard truck guard, wherein the guard body 20' has an arc-shaped cross section to form a longitudinal receiving cavity 201' having a sized and shaped adapted for fittedly receiving the bottom portion 11 of the truck 10 and a first and second longitudinal edges 202', 203' defined at an elongated opening of the receiving cavity 201'. The inner side 22' is defined at an inner peripheral surface of the receiving cavity 201' in such a manner that when the guard body 20' is mounted on the bottom portion 11 of the truck 10, the inner side 22' is covered up the ground contacting surface 12 of the truck 10, so as to protect the ground contacting surface 12 of the truck 10 being grinded along a sliding surface such as railing or curb. Thus, the grinding surface 211' is provided on the outer side 21' of the guard body 20' at a position that projecting from the ground contacting surface 12 of the truck 10 when the guard body 20' is mounted thereto.

The guard body 20' further has a longitudinal protruding portion 24' inwardly projected towards the receiving cavity 201' for fittedly engaging with an engagement groove 15 longitudinal formed on the bottom portion 11 of the truck 10 so as to align and hold the guard body 20' in position with respect to the truck 10. Moreover, a foaming layer 40' is provided on the inner side 22' of the guard body 40' for filling a gap form between the inner side 22' of the guard body and the ground contacting surface 12 of the truck 10.

The guard body 20' further comprises a holding member 25' for holding the guard body 20' on the truck 10 in position wherein the holding member 25' comprises an arc-shaped holding rib 251' integrally extended from the second longitudinal edge 203' of the guard body 20' for fittedly engaging with a corresponding arc-shaped joint portion 16 of the truck 10 that a bushing assembly 17 is attached thereto.

The guard body 20' further has a tongue portion 27' integrally extended from the first longitudinal edge 202' of the guard body 20' for covering a neck portion of 18 of the truck 10, so as to form the detaching pusher button 26' at an end portion of the tongue portion 27' of the guard body 20'.

The fastening arrangement 30' comprises a fastening element 31' mounted at the tongue portion 27' of the guard body 20' wherein the fastening element 31' is arranged to form a fastening loop 310' for tightly encircling the tongue portion 27' of the guard body 20' with the neck portion 18 of the truck 10.

The fastening element 31' has a first and second fastening portions 311', 321' and a retaining portion 313' provided therebetween, wherein the retaining portion 313 is held on the guard body 20' in position and the first and second fastening portions 311', 312' are arranged to fasten with each other to form the fastening loop 310' for tightly encircling with the tongue portion 18 of the truck 10. Accordingly, the fastening element 31' is a zip-tie, wherein the first fastening portion 311' of each of the fastening elements 31' has a locker member 3111' having a slider through slot 3112' and the second fastening portion 312' of each of the fastening elements 31 has a plurality of engaging teeth 3121' spacedly provided thereon to interlock with the locker member 3111'.

The guard body 20' further a guiding groove 23' longitudinally provided on the tongue portion 27' of the guard body 20' for holding the retaining portion 313' of the fastening element 31 in position. Accordingly, the guiding groove 23' is longitudinally formed on the outer side 21' of the guard body 20' in such a manner that the retaining portion 313' of the fastening element 31' is received in the guiding groove 23' so as to hold the fastening element 31' on the guard body 20'.

Figure 7:
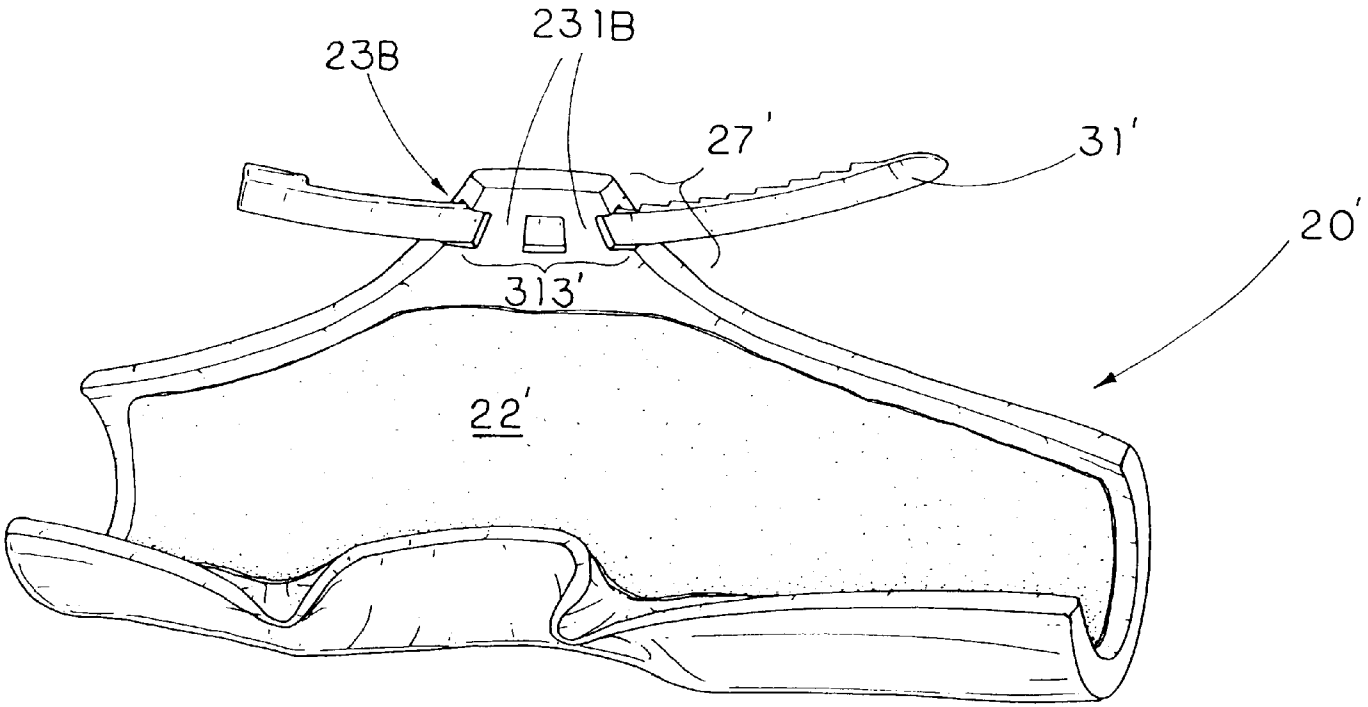
FIG. 7 illustrates an alternative mode of a guard body of the skateboard truck guard according to the above second preferred embodiment of the present invention.

FIG. 7 illustrates an alternative mode of the guiding groove 23B provided at the inner side 22' of the tongue portion 27' of the guard body 20', wherein the guard body 20' further comprise at least a holding ridge 231B formed on the inner side 22' of the guard body 20' for enclosing the guiding groove 23B in such a manner that the fastening elements 31' is adapted to slidably passing through the guiding groove 23B while the retaining portion 313' of the fastening element 31' is held in the guiding groove 23B.

While the foregoing description and diagrams describe the preferred embodiment and its alternative modes of the present invention, it should be appreciated that certain obvious modifications, variations, and substitutions may be made without departing from the spirit and scope of the present invention. For example, the shape of the guard body 20 can be further modified as long as the ground contacting surface 12 of the truck 10 is covered by the guard body 20 so as to provide a grinding surface 211 thereof. Moreover, it is apparent that the zip-ties of the fastening elements 30 can be replaced by other fasteners, such as loop-shaped clips or durable wires, for securely attaching the guard body 20 to the truck 10.

What is claimed is:

1. A skateboard truck guard for attaching to a truck having a bottom portion and defining a ground contacting surface thereon, comprising:

an elongated guard body, which is shaped and sized for detachably mounting to said bottom portion of said truck, having an outer side and defining a grinding surface thereon and an inner side for covering said ground contacting surface; and a fastening arrangement mounted on said guard body for securely fastening said guard body on said truck, wherein said fastening arrangement comprises two elongated fastening elements mounted at two end portions of said guard body respectively, wherein each of said fastening elements is arranged to form a fastening loop for tightly encircling said two end portions of said guard body with two side portions of said truck, so as to securely attach said guard body to said truck.

2. A skateboard truck guard, as recited in claim 1, wherein each of said fastening elements has a first and second fastening portions and a retaining portion provided therebetween, wherein said retaining portion is held on said guard body in position and said first and second fastening portions are arranged to fasten with each other to form said fastening loop for tightly encircling with two side portions of said truck.

3. A skateboard truck guard, as recited in claim 2, wherein said guard body further has two guiding grooves transversely indented on said two end portions of said outer surface of said guard body respectively such that said retaining portions of said fastening elements are received in said guiding grooves respectively so as to retain said two fastening elements on said two end portions of said guard body in position respectively.

4. A skateboard truck guard, as recited in claim 3, wherein said guard body further has a longitudinal protruding portion projecting from said inner side of said guard for fittedly engaging with an engagement groove which is longitudinal formed on said bottom portion of said truck, so as to align and hold said guard body in position.

5. A skateboard truck guard, as recited in claim 4, wherein said guard body further comprises an arc-shaped holding rib integrally extended from a second longitudinal edge of said guard body for fittedly engaging with a corresponding arc-shaped joint portion of said truck that a bushing assembly is attached thereto, so as to securely hold said guard body on said truck in position.

6. A skateboard truck guard, as recited in claim 2, wherein said guard body further has two guiding grooves transversely indented on said two end portions of said inner surface of said guard body respectively and at least two holding ridges formed on said inner side of said guard body for enclosing said guiding grooves respectively in such a manner that each of said fastening elements is adapted to slidably pass through said respective guiding groove while said retaining portion of said fastening element is held in said guiding groove.

7. A skateboard truck guard, as recited in claim 6, wherein said guard body further has a longitudinal protruding portion projecting from said inner side of said guard for fittedly engaging with an engagement groove which is longitudinal formed on said bottom portion of said truck, so as to align and hold said guard body in position.

8. A skateboard truck guard, as recited in claim 7, wherein said guard body further comprises an arc-shaped holding rib integrally extended from a second longitudinal edge of said guard body for fittedly engaging with a corresponding arc-shaped joint portion of said truck that a bushing assembly is attached thereto, so as to securely hold said guard body on said truck in position.

9. A skateboard truck guard, as recited in claim 1, wherein said guard body further has a longitudinal protruding portion projecting from said inner side of said guard for fittedly engaging with an engagement groove which is longitudinal formed on said bottom portion of said truck, so as to align and hold said guard body in position.

10. A skateboard truck guard, as recited in claim 9, wherein said guard body further comprises an arc-shaped holding rib integrally extended from a second longitudinal edge of said guard body for fittedly engaging with a corresponding arc-shaped joint portion of said truck that a bushing assembly is attached thereto, so as to securely hold said guard body on said truck in position.

11. A skateboard truck guard for attaching to a truck having a bottom portion and defining a ground contacting surface thereon, comprising:

an elongated guard body, which is shaped and sized for detachably mounting to said bottom portion of said truck, having an outer side and defining a grinding surface thereon and an inner side for covering said ground contacting surface, wherein said guard body further has a tongue portion integrally extended from a first longitudinal edge of said guard body for covering a neck portion of said truck, and a fastening arrangement mounted on said guard body for securely fastening said guard body on said truck, wherein said fastening arrangement comprises an elongated fastening element mounted on said tongue portion of said guard body and arranged to form a fastening loop for tightly encircling said tongue portion of said guard body with said neck portion of said truck, so as to securely attach said guard body to said truck.

12. A skateboard truck guard, as recited in claim 11, wherein each of said fastening elements has a first and second fastening portions and a retaining portion provided therebetween, wherein said retaining portion is held on said guard body in position and said first and second fastening portions are arranged to fasten with each other to form said fastening loop for tightly encircling with two side portions of said truck.

13. A skateboard truck guard, as recited in claim 12, wherein said guard body further has a guiding groove longitudinally indented on said tongue portion of said outer surface of said guard body respectively such that said retaining portion of said fastening element is received in said guiding groove so as to retain said fastening element on said tongue portion of said guard body in position.

14. A skateboard truck guard, as recited in claim 13, wherein said guard body further has a longitudinal protruding portion projecting from said inner side of said guard for fittedly engaging with an engagement groove which is longitudinal formed on said bottom portion of said truck, so as to align and hold said guard body in position.

15. A skateboard truck guard, as recited in claims 14, wherein said guard body further comprises an arc-shaped holding rib integrally extended from a second longitudinal edge of said guard body for fittedly engaging with a corresponding arc-shaped joint portion of said truck that a bushing assembly is attached thereto, so as to securely hold said guard body on said truck in position.

16. A skateboard truck guard, as recited in claim 12, wherein said guard body further has a longitudinal protruding portion projecting from said inner side of said guard for fittedly engaging with an engagement groove which is longitudinal formed on said bottom portion of said truck, so as to align and hold said guard body in position.

17. A skateboard truck guard, as recited in claim 12, wherein said guard body further has a guiding groove longitudinally indented on said tongue portion of said inner surface of said guard body and at least a holding ridge formed on said inner side of said guard body for enclosing said guiding groove in such a manner that said fastening element is adapted to slidably pass through said guiding groove while said retaining portion of said fastening element is held in said guiding groove.

18. A skateboard truck guard, as recited in claim 17, wherein said guard body further has a longitudinal protruding portion projecting from said inner side of said guard for fittedly engaging with an engagement groove which is longitudinal formed on said bottom portion of said truck, so as to align and hold said guard body in position.

19. A skateboard truck guard, as recited in claim 18, wherein said guard body further comprises an arc-shaped holding rib integrally extended from a second longitudinal edge of said guard body for fittedly engaging with a corresponding arc-shaped joint portion of said truck that a bushing assembly is attached thereto, so as to securely hold said guard body on said truck in position.

* * * * *